US006171694B1

(12) United States Patent
Emmerich et al.

(10) Patent No.: US 6,171,694 B1
(45) Date of Patent: Jan. 9, 2001

(54) MARKER FOR USE IN MAGNETOELASTIC ELECTRONIC ARTICLE SURVEILLANCE SYSTEM

(75) Inventors: Kurt Emmerich, Alzenau; Giselher Herzer, Bruchköbel, both of (DE)

(73) Assignee: Vacuumschmelze Gmbh, Hanau (DE)

( * ) Notice: Under 35 U.S.C. 154(b), the term of this patent shall be extended for 0 days.

(21) Appl. No.: 09/319,760

(22) PCT Filed: Dec. 11, 1997

(86) PCT No.: PCT/DE97/02893

§ 371 Date: Jun. 11, 1999

§ 102(e) Date: Jun. 11, 1999

(87) PCT Pub. No.: WO98/26390

PCT Pub. Date: Jun. 18, 1998

(30) Foreign Application Priority Data

Dec. 11, 1996 (DE) ..... 196 51 525

(51) Int. Cl.[7] ..... G08B 13/24

(52) U.S. Cl. ..... 428/332; 428/692; 340/551; 340/572.1

(58) Field of Search ..... 428/692, 220, 428/332; 340/551, 572.1

(56) References Cited

U.S. PATENT DOCUMENTS 5,728,237 3/1998 Herzer ..... 148/304

FOREIGN PATENT DOCUMENTS 94 12 456 12/1994 (DE) .
OS 195 45 755 6/1997 (DE) .
0 086 485 8/1983 (EP) .
WO 90/03652 4/1990 (WO) .
WO 96/32731 10/1996 (WO) .

*Primary Examiner*—Stevan A. Resan
(74) *Attorney, Agent, or Firm*—Schiff Hardin & Waite

(57) ABSTRACT

A label for use in a magnetoelastic electronic article surveillance system has a strip of an amorphous alloy, forming a resonator having a resonant frequency, when activated by a magnetically semi-hard strip. The strip of amorphous alloy is fixed at one side to the magnetically semi-hard strip, and has a length of ¼ wavelength of the resonant frequency.

25 Claims, No Drawings

MARKER FOR USE IN MAGNETOELASTIC ELECTRONIC ARTICLE SURVEILLANCE SYSTEM

BACKGROUND OF THE INVENTION

1. Field of the Invention

The present invention is directed to a marker (or tag or label) suitable for use in an electronic article surveillance system of the type making use of magnetoelastic (magnetostrictive) properties of the marker in order to trigger an alarm under appropriate circumstances.

2. Description of the Prior Art

Magnetoelastic anti-theft security labels are utilized on the basis of an amorphous strip as resonator and of a magnetically semi-hard strip arranged parallel to each other for setting the resonant frequency. These magneto-elastic strips usually contain monitoring strips that are composed of a preferably amorphous alloy with high-magnetostriction and that are mechanically freely movable within a label housing.

These amorphous alloys are based, for example, on alloy systems that, in addition to containing Fe, also contain Ni (WO 90/03652) or that, in addition to containing Fe, also contain Ni and Co (Utility Model G94 12 456.6), and that are excited by an external excitation with an alternating field pulse, being excited to execute longitudinal, mechanical resonant oscillations.

Such magneto-elastically excitable labels for monitoring and identification systems that are composed of a magnetically semi-hard strip for the deactivation and of an amorphous strip as resonator are also disclosed by WO-A-96/32731.

As a result of the magnetostrictive coupling, the mechanical stresses linked to the oscillation cause a change in magnetization that induces a corresponding alternating voltage in the reception coil, the label being thus detected. The characteristic of the label is the resonant frequency of the amorphous strip that, in addition to being dependent on the length of the label, is also dependent on the constant field pre-magnetization of the magnetically semi-hard strip arranged parallel thereto. The matching of the amorphous strip in terms of its length to the flux of the magnetized, magnetically semi-hard strip determines the resonant frequency of the label in the activated condition. This resonant frequency must clearly differ from the resonant frequency of the amorphous strip without constant field pre-magnetization or with low constant field pre-magnetization, since this shift of the resonant frequency is required for the de-activation of the labels. The setting of an adequately large shift of the resonant frequency for deactivation, however, results in a not inconsiderable sensitivity of the resonant frequency to be detected to variations in the properties of the amorphous strip as well as of the magnetically semi-hard strip with respect to the pre-magnetization (for example, G. Herzer, U.S. Pat. No. 5,728,237).

According to the prior art, amorphous strips and magnetically semi-hard strips are separately manufactured and a matching of the properties is separately undertaken for both strips. Accordingly, the criteria made of the utilized strips in terms of their properties and, in particular, in terms of the deviations of the properties within large run lengths are extremely critical and lead to unsatisfactory yield values in the overall process.

According to the prior art, the labels are presented with freely oscillating, amorphous strips, so that the label length corresponds to exactly half the wavelength of the resonant frequency. In order to obtain more economical labels, the width of the strips can be reduced only within a limited scope given the resonant frequency established by the system.

SUMMARY OF THE INVENTION

The invention is directed to the manufacture and to the design of labels for employment in systems for protecting and identifying goods, whereby the magneto-elastic monitoring strip is fixed at one side and is excited in the system to execute an oscillation with a ¼ wavelength of the resonant frequency. The invention is also directed to the matching of the properties of the label during manufacture, so that a clear reduction made of the demand made upon the strips utilized (preferably amorphous and magnetically semi-hard) can be achieved in comparison to the demands on the strip made by the prior art.

DESCRIPTION OF THE PREFERRED EMBODIMENTS

The following exemplary embodiments describe the inventive labels and their manufacture:

A magnetically semi-hard material having the width of 6 mm and the thickness of 62 $\mu$m of SEMIVAC 90 is applied onto a double-sided adhesive strip having the width of 12 mm, this material, in its magnetized condition, introducing a flux of approximately 730 nWb into a closed magnetic circuit via its remanence Br=1.2 T. An amorphous strip of VITROVAC 7250 (Fe—Co—Ni—Si—B—C) having the width of 6 mm and the thickness 25 $\mu$m is secured on this magnetically semi-hard SEMIVAC 90 by spot welding, whereby a linear magnetization curve, a defined magnetostriction (the magneto-elastic resonant behavior derives therefrom) and a transverse curvature having been set in the amorphous strip with a thermal treatment in the field. The spot welding fixings are composed of one or more spot welds next to one another that respectively fix the amorphous strip on the SEMIVAC 90 at a spacing of exactly 23 mm. A hole covering both strips is subsequently punched next to the spot weld location at this composite strip, so that the amorphous strip is only fixed by one or more spot weld locations at one side and has a freely oscillating length of 19 mm. In the following manufacturing steps, the magnetically semi-hard strip is magnetized and the resonant frequency of the amorphous strip is measured. The exact positioning of the punched holes relative to the following spot weld locations is calculated in a closed control circuit from the measured resonant frequency, so that a tight tolerancing of the resonant frequency (for example, 58 kHz±100 Hz) can also be achieved even with greater standard deviations of the two strips, insofar as the variation of the properties occurs over lengths that is [sic] long compared to the label length (approximately 20 mm). In one example, it was capable to level flux modifications of the magnetically semi-hard strip of ±20%, whereas ±5% given conventional labels already leads to problems in manufacture. The label manufacture is terminated by placing a plastic profile part on that protects the freely oscillating end of the amorphous stripe against mechanical manipulation during employment.

A further embodiment of the inventive labels substitutes the spot weld procedure with the application of a transversely glued, double-sided adhesive strip that, corresponding to the spot weld locations, assures the fixing of the amorphous strip at uniform intervals. The rest of the manufacturing process proceeds analogously.

Although modifications and changes may be suggested by those skilled in the art, it is the intention of the inventors to embody within the patent warranted hereon all changes and modifications as reasonably and properly come within the scope of their contribution to the art.

What is claimed is:

1. Magneto-elastically excitable label for a monitoring and identification system, comprising:

an activatable strip of a amorphous alloy forming a resonator, having a resonant frequency, when activated;

a magnetically semi-hard strip for deactivation of said strip of an amorphous alloy; and said strip of an amorphous alloy being fixed at one side and having a length of ¼ wavelength of the resonant frequency.

2. Magneto-elastically excitable label according to claim 1, wherein said amorphous alloy has the formula:

$$Fe_aCo_bNi_cSi_xB_yM_z,$$

whereby M denotes at least one element of group IV through group VII of the periodic table including at least one of C, Ge and P and wherein a, b, c, x, y and z are in at % and a lies between 20 and 74, b lies between 0 and 50, c lies between 0 and 50, with b+c>5, x lies between 0 and 10, y lies between 10 and 20, z lies between 0 and 5, and x+y+z lies between 12 and 24.

3. Magneto-elastically excitable label according to claim 1, wherein said amorphous alloy has the formula:

$$Fe_aCo_bNi_cSi_xB_yM_z,$$

whereby M denotes at least one element of group IV through group VII of the periodic table including at least one of C, Ge and P, and wherein a b, c, x, y and z are in at % and a lies between 20 and 74, b lies between 0 and 25, c lies between 0 and 50, with b+c>5, x lies between 0 and 10, y lies between 10 and 20, z lies between 0 and 5, and x+y+z lies between 12 and 24.

4. Magneto-elastically excitable label according to claim 1, wherein said amorphous alloy has the formula:

$$Fe_aCo_bNi_cSi_xB_yM_z,$$

whereby M denotes at least one element of group IV through group VII of the periodic table including at least one of C, Ge and P and wherein a, b, c, x, y and z are in at % and a lies between 20 and 74, b lies between 0 and 15, c lies between 0 and 50, with b+c>5, x lies between 0 and 10, y lies between 10 and 20, z lies between 0 and 5, and x+y+z lies between 12 and 24.

5. Magneto-elastically excitable label according to claim 1, said strip of an amorphous alloy has a magnetization loop set by a thermal treatment in a magnetic field that is so flat that, given a change in an attitude of the label, a change in the resonant frequency caused by the earth's magnetic field is less than 1 kHz, and which is so steep that a difference of the resonant frequency without pre-magnetization and with pre-magnetization is greater than 1 kHz.

6. Magneto-elastically excitable label according to claim 1, wherein said strip of an amorphous alloy has a transverse curvature, so that contact between said strip of an amorphous alloy and said magnetically semi-hard strip, next to a location at which said strip of an amorphous alloy is fixed to said magnetically semi-hard strip, proceeds only along a line.

7. Magneto-elastically excitable label according to claim 1, wherein said strip of an amorphous alloy has a freely oscillating length between 15 and 25 mm, a width between 0.5 and 25 mm, and a thickness between 15 and 40 $\mu$m.

8. Magneto-elastically excitable label according to claim 1, wherein said strip of an amorphous alloy is sufficiently ductile to be trimmed to length by punching procedures without splintering.

9. Magneto-elastically excitable label according to claim 1, wherein said magnetically semi-hard strip loses less than 5% of its induction in a magnetized condition due to noise fields <20 A/cm.

10. Magneto-elastically excitable label according to claim 1, wherein said magnetically semi-hard strip loses less than 5% of its induction in a magnetized condition due to noise fields <10 A/cm.

11. Magneto-elastically excitable label according to claim 1, wherein said magnetically semi-hard strip can be brought 5% to a saturation induction by a field of 400 A/cm.

12. Magneto-elastically excitable label according to claim 1, wherein said magnetically semi-hard strip can be brought 5% to a saturation induction by a field of 200 A/cm.

13. Magneto-elastically excitable label according to claim 1, wherein said magnetically semi-hard strip can be brought 5% to a saturation induction by a field of 50 A/cm.

14. Magneto-elastically excitable label according to claim 1, wherein said magnetically semi-hard strip has a coercive field strength between 10 A/cm and 60 A/cm.

15. Magneto-elastically excitable label according to claim 1, wherein said magnetically semi-hard strip has a coercive field strength between 10 A/cm and 30 A/cm.

16. Magneto-elastically excitable label according to claim 1, wherein said magnetically semi-hard strip has a remanence Br>1.0 T.

17. Magneto-elastically excitable label according to claim 1, wherein said magnetically semi-hard strip has a remanence Br>1.2 T.

18. Magneto-elastically excitable label according to claim 1, wherein said magnetically semi-hard strip has a thickness between 25 $\mu$m and 100 $\mu$m.

19. Magneto-elastically excitable label according to claim 1, wherein each of said strip of an amorphous alloy and said magnetically semi-hard strip has a width, and wherein the respective widths of the strip of an amorphous alloy and the magnetically semi-hard strip deviate from one another by no more than 20%.

20. A method for manufacturing a magneto-elastically excitable label comprising the steps of:

providing a continuous ribbon of an amorphous alloy;

providing a continuous ribbon of a magnetically semi-hard material;

fixing said continuous ribbon of an amorphous alloy to said continuous ribbon of magnetically semi-hard material at uniform intervals; and producing a magneto-elastically excitable label by punching through both of said continuous ribbon of amorphous alloy and said continuous ribbon of magnetically semi-hard material, to produce a label comprising an activatable strip of said amorphous alloy forming a resonator, having a resonant frequency, when activated and a strip of said magnetically semi-hard material for deactivating said strip of said amorphous alloy, having a length of ¼ wavelength of said resonant frequency.

21. Method according to claim 20 comprising providing a label housing containing said magnetically semi-hard strip and said strip of an amorphous alloy, and securing the magnetically semi-hard strip in the label housing with an adhesive layer.

22. Method according to claim 20 comprsing fixing said strip of an amorphous alloy to said magnetically semi-hard strip by at least one spot weld.

23. Method according to claim 20 comprising fixing said strip of an amorphous alloy to said magnetically semi-hard strip with an adhesive layer.

24. Method according to claim 20 comprising controlling a length of the label resonator during punching dependent on measurements of the respective resonant frequencies of preceding labels punched from said ribbons.

25. Method according to claim 20 comprising placing a plastic profile over said strip of an amorphous alloy that assures a free longitudinal oscillation of the strip of an amorphous alloy as said resonator.

* * * * *